United States Patent [19]

Arakawa et al.

[11] 4,422,484

[45] Dec. 27, 1983

[54] WEFT GUIDE DEVICE IN A JET LOOM

[75] Inventors: Hiroshi Arakawa, Kariya; Kinpei Mitsuya, Aichi, both of Japan

[73] Assignee: Kabushiki Kaisha Toyoda Jidoshokki Seisakusho, Kariya, Japan

[21] Appl. No.: 324,609

[22] Filed: Nov. 24, 1981

[30] Foreign Application Priority Data

Nov. 28, 1980 [JP] Japan ..... 55-168652

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 4,190,067 2/1980 Kuda et al. ..... 139/435

FOREIGN PATENT DOCUMENTS 19418 11/1980 European Pat. Off. ..... 139/435

2022630 12/1979 United Kingdom ..... 139/435

*Primary Examiner*—Henry Jaudon

*Attorney, Agent, or Firm*—Brooks, Haidt, Haffner & Delahunty

[57] ABSTRACT

A weft guide device in a jet loom having a reed carrier for carrying a reed thereon is disclosed. The guide device made according to this invention generally comprises an array of weft guide members mounted on said reed carrier along the reed and each having a concave to provide a weft guide path, said concave being provided with a relatively narrow opening and defined by surfaces including a substantially vertically extending surface joining with said opening, and a surface opposite said substantially vertically extending surface through said concave.

According to this invention, the upper portion of said substantially vertically extending surface is curved toward said opposite surface.

3 Claims, 5 Drawing Figures

WEFT GUIDE DEVICE IN A JET LOOM

BACKGROUND OF THE INVENTION

This invention relates to a weft guide device in a jet loom.

Heretofore, in order to allow a weft to be smoothly inserted through the warp shed of a jet loom by flow of air discharged from a main nozzle arranged in a known manner, a weft guide device has been provided which comprises a number of weft guide members arranged near the reed in line with each other in the weft insertion direction, the weft guide members each being provided, for example on the side of the reed, with interiorly facing surfaces providing either a large weft guide opening (hereinafter referred to as the open type) or a small weft guide opening (hereinafter referred to as the closed type) sufficiently narrow to just allow the escapement of the weft therethrough, these surfaces being in alignment with each other to provide a weft guide path, and a suitable number of air discharge sub-nozzles arranged in predetermined locations along the weft guide path so that air outlets formed therein face the weft guide path. In this weft guide device, each of the sub-nozzles discharges a jet of air assisting the air jet from the main nozzle in carrying out the weft insertion; otherwise the leading end of the weft will not be able to be moved far enough during the weft inserting operation.

However, the weft guide device employing the open type weft guide members encounters the problems that because of the large openings provided by the respective weft guide surfaces of the guide members, the air discharged from the main and sub-nozzles is apt to easily escape through the large openings, resulting in a larger air consumption; and that during the weft inserting operation, the leading end of the weft may be entrained in the air currents escaping through the openings and erroneously moved out of the weft guide path.

In the weft guide device employing the closed type guide members, the weft insertion can not rely on the main nozzle alone when inserting through a relatively long weft guide path. Thus, some of the weft guide members arranged in the predetermined positions are formed into a hollow structure with an air passage therein and air outlet or outlets facing the weft guide path so that the pressurized air supplied to the air passage is discharged through the outlet or outlets into the weft guide path. However, since these hollow members require that the air passage and outlet(s) be formed therein while maintaining them in a shape similar to the remaining weft guide members, it is difficult to conform the size or dimensions of the hollow members to the remaining weft guide members. For example, the small opening, provided in the concave of each hollow member to allow the weft to escape from the weft guide path after the weft insertion, becomes inconsistent in position with the small openings in the remaining weft guide members. This may result in the failure of the weft insertion. Furthermore, it is difficult to ensure that the air outlet is so opened that the air flow therethrough is directed in the predetermined direction allowing the air flow to attain its object of assisting the main nozzle. This results in a critical disadvantage directly affecting the weft inserting function of the guide device. Thus, it is understood that the guide device employing the closed type guide members requires highly advanced manufacturing technology.

For these reasons, Japanese laid-open patent specification No. 55-128,047 has proposed a combined weft guide device including, as shown in FIGS. 1(A) and 1(B) hereof, both open type guide members 2 each having a concave shaped interior surface 1 with a large opening 5 on the left-hand side thereof, and closed type guide members 4 each having an interior surface 3 providing a small opening 6, in order to positively utilize the advantages of the open and closed type guide members. In this combined device, guide members 2 (FIG. 1(B)) are deliberately scattered throughout the array of guide members 4 (FIG. 1(A)) with their respective concaved surfaces 1 and 3 arranged in line. The weft escape openings 5 and 6 are formed on the side of a reed 12 as can be seen in FIG. 2. In front of the escape opening 5 of each guide member 2, a vertical sub-nozzle 19 (FIG. 2) is arranged to provide an auxiliary flow of air, and the weft escape opening 6 is provided on the side of the reed and in the upper part of concaved surface 3 between first and second arms 7 and 8 of weft guide member 4.

This combined guide device can prevent to some degree a great loss of discharged air accompanied by a weft insertion error. Also, this combined guide device does not require that an air passage be formed in any of the weft guide members and therefore can eliminate the difficulty in manufacturing the weft guide members.

However, in the combined guide device described above, as shown in FIG. 1(A), the second arm 8 of guide member 4 has an inner wall surface 3*d* (defining the rear wall of the surface 3) extending substantially straight upward to define opening 6. The substantially straight surface 3*d* can not cause the air discharged into the weft guide path to be effectively and satisfactorily converged during the weft inserting operation. Therefore, the air flow in the weft guide path is apt to branch away to the weft escape openings 5 and 6. This causes not only an increased air consumption, but also an unexpected movement of the weft through the openings out of the weft guide path entrained in the branch air flow, resulting in the failure of the weft insertion. In other words, the air flow discharged from the sub-nozzle is blown against the fore wall surface 3*a* of the concaved surface 3 and thereafter a portion thereof flows along the lower wall surface 3*c* toward the rear of the jet loom (the side of the second arm 8) and then upwardly along the rear wall surface 3*d* toward opening 6. Thus, said portion of the air flow is discharged out of the weft guide path through opening 6 and causes the failure of the weft insertion.

Accordingly, it is a primary object of this invention to provide a weft guide device for a jet loom, which, in order to eliminate the disadvantages of the prior art, can effectively use main and auxiliary air flows to decrease power consumption, allows easy manufacture of weft guide members, and enables a weft to pass through a weft guide path in a stable state to increase the speed of a weft insertion and cause the leading end of the weft to travel a longer distance, resulting in increased width in high speed jet looms.

SUMMARY OF THE INVENTION

With this object in view, the present invention resides in a weft guide device in a jet loom having a reed carrier for carrying a reed thereon, said device comprising an array of weft guide members mounted on said reed carrier along the reed, each of said guide members having interiorly facing surface to provide a weft guide path, said surface being provided in its upper portion with a relatively narrow opening to allow a weft to move therethrough out of said guide path in preparation for the beating by said reed, and air discharge members spacedly disposed in said guide member array and on the side of said opening to discharge air flows into said guide path, said interiorly facing surface being defined by surfaces including a substantially vertically extending surface having a curved upper portion joining with said opening, to direct air which is moving upwardly therealong towards a surface opposite said substantially vertically extending surface.

BRIEF DESCRIPTION OF THE DRAWINGS

The invention will become more readily apparent from the following description of a preferred embodiment thereof shown, by way of example only, in the accompanying drawings, wherein.

DESCRIPTION OF THE PREFERRED EMBODIMENT

Figure 1A:
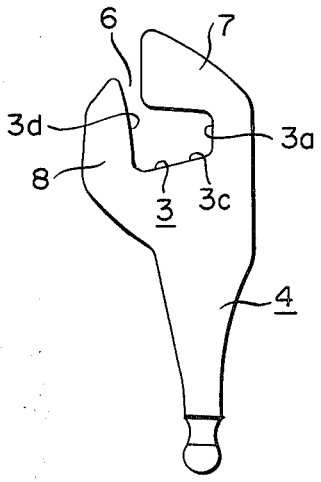
FIGS. 1(A) and (B) show side elevational views of the prior weft guide members.
Figure 1B:
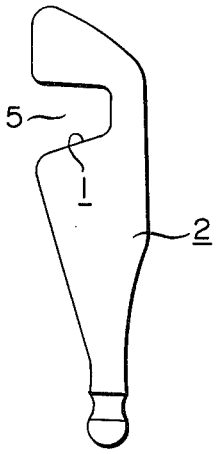
PRIOR ART FIG.1(B)
Figure 2:
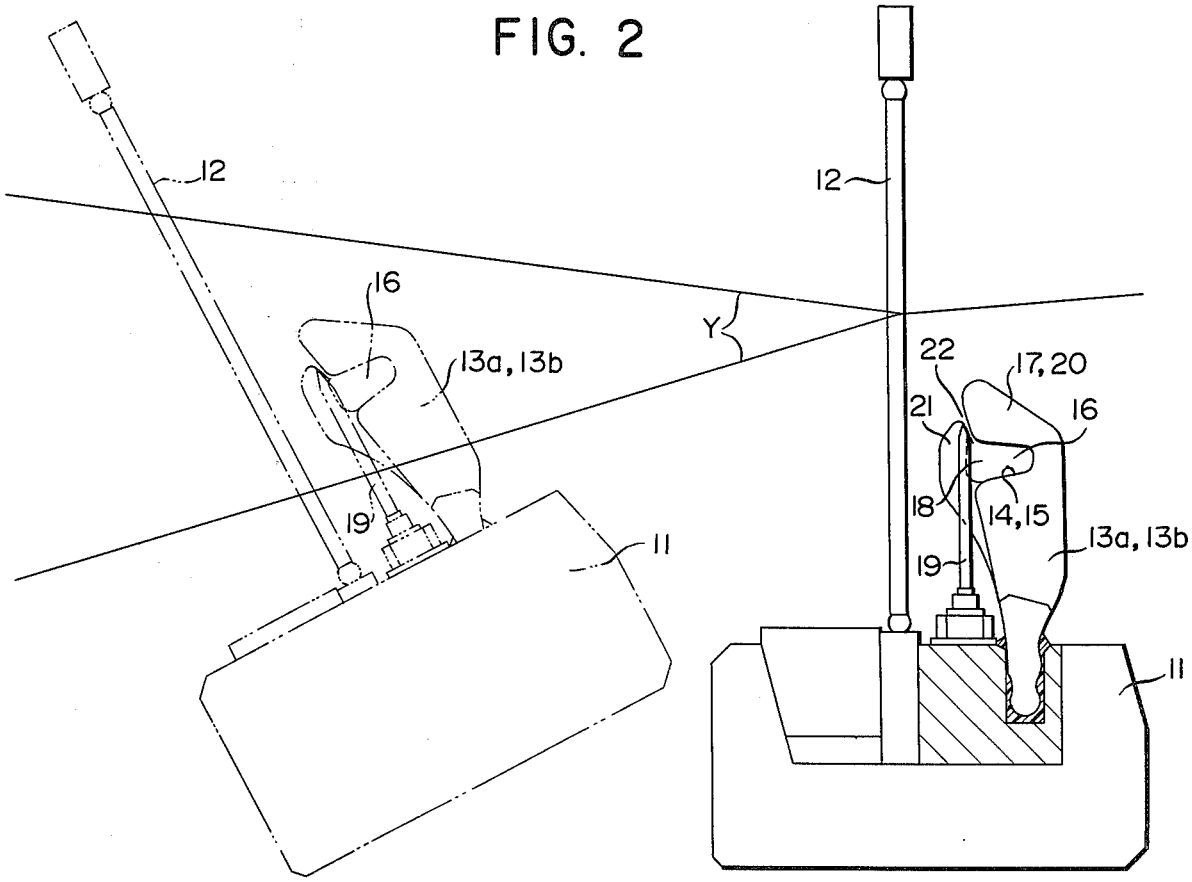
PRIOR ART FIG. 2
FIG. 2 is a side elevational view showing a beating apparatus including a weft guide device made in accordance with this invention.

Referring to FIG. 2, there is shown a beating apparatus comprising a reed carrier 11 having a reed 12 mounted thereon. A number of weft guide members 13*a*, 13*b* are spacedly mounted on the carrier 11 in parallel with the reed 12.

Figure 3A:
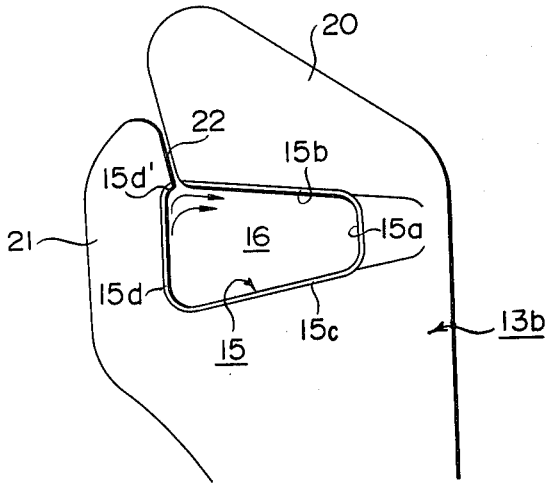
FIG. 3(A) is an enlarged fragmentary side elevation of a weft guide member according to the present invention; and FIG. (B) is a similarly enlarged fragmentary side elevation of an open-type weft guide member which is used with the weft guide member of FIG. 3(A) in accordance with an alternative embodiment of the insertion.
Figure 3B:
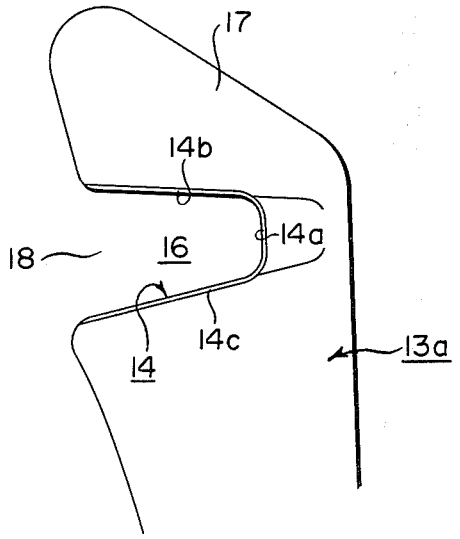

Referring to FIGS. 2 and 3, each of the guide members 13*a* and 13*b* includes interior facing surfaces 14 or 15 forming a weft guide opening 16 of the guide member. The surfaces 14 and 15 are arranged in line with other. The surface 14 is formed only by a curved arm 17 of the weft guide 13*a* so that it has a large opening 18 on the rearward side of the reed 12. The surface 14 is defined by three wall surfaces 14*a*, 14*b* and 14*c*. As shown in FIG. 2, a substantially vertically disposed sub-nozzle 19 is mounted on the reer carrier opposite the opening 18. The surface 15 of the other guide member 13*b* is formed defined by a first arm 20 corresponding in shape to the arm 17 of the guide member 13*a*, and a second arm 21 branching off the first arm 20 so as to be in line with the sub-nozzle 19 with respect to the direction of a weft insertion. The free ends of, the first and second arms 20 and 21 approach each other to provide a relatively small weft thread opening 22 therebetween. The weft inserted through the weft guide path formed by the aligned weft guide openings 16 is adapted to move thereout of through the openings 18 and 22 before the beating.

The width of the opening 22 in the direction perpendicular to the end surfaces of the free ends of the first and second arms 20 and 21 is narrow as shown and the opening 22 extends upwardly with the same width along its entire length.

The interior surface 15 of the guide member 13*b* is defined by four conjoining wall surfaces 15*a*, 15*b*, 15*c* and 15*d* to provide the quadrilaterally shaped weft guide opening 16. A first arm 20 of the guide member 13*b* provides the upper and lower wall surfaces 15*b* and 15*c*, and the surface 15*a* positioned towards the forward end of the loom, while the second arm 21 provides the substantially vertical wall surface 15*d* positioned towards the rear of the loom. The rear wall surface 15*d* of the guide member 13*b* is in communication with the opening 22 with its upper portion 15*d'* being curved forward (toward the end of the upper wall surface 15*b*). The curved upper portion 15*d'* serves to smoothly guide the air flow, which ascends along the rear wall surface 15*d*, toward a space below the upper wall surface 15*b* without allowing it to flow into the opening 22.

The operation of the above guide device will be described as follows:

The solid lines in FIG. 2 show the condition immediately after the beating, under which the sub-nozzles 19 (only one thereof is illustrated) and the guide members 13*a* and 13*b* have moved out of the shed formed by warps Y. When the reed carrier 11 moves from the position shown by the solid lines toward the rear of the loom into the position shown by the phantom lines while healed frames not shown move vertically to form a new shed, the sub-nozzles 19 and the guide members 13*a*, 13*b* enter the new shed as shown by the phantom lines in FIG. 2. Then, in timed relationship with such a movement of the guide device, a not shown main nozzle discharges a main flow of air in which the leading end of the weft is entrained and inserted through the weft guide path formed by the openings 16 of the guide members 13*a* and 13*b*. Also, each sub-nozzle 19 discharges an auxiliary air flow in the known manner to assist the main air flow in performing the weft insertion. The auxiliary air from the sub-nozzle 19 is discharged toward the fore wall surfaces 15*a* of the guide member 13*b* positioned downstream of said sub-nozzle 19 with respect to the direction of the weft insertion. That is, the auxiliary air flow is discharged obliquely with respect to the direction of the weft insertion. Thus, when the leading end of the weft as well as the main air flow entraining same goes across the auxiliary air flow, it is subject to, in addition to the propulsive force acting in the direction of the weft insertion, a force positively forcing the weft toward the fore wall surfaces 15*a* of the weft guide path formed by opening 16. This means that all of the air flowing within the weft guide path has a tendency to proceed toward the wall surface 15*a*, that is, away from the openings 22.

A portion of the air flow which is blown against the wall surface 15*a* descends and passes along the lower wall surface 15*c* and then ascends the rear wall surface 15*d* toward the opening 22. However, there is little air entering the opening 22 because of the presence of the curved upper portion 15*d'*, which smoothly guides the ascending air towards the upper wall surface 15*b*. Thus, it is understood that air escape through the opening 22 can be prevented, resulting in the prevention of weft insertion errors.

Furthermore, any flow of air toward the opening 22 will be positively directed toward the lower portion of the fore wall surface 15*a* of the associated weft guide member 13*b* by the auxiliary air flow from the sub-nozzle 19 positioned upstream of said weft guide member 13*b*. Thus, the auxiliary air flows discharged from the sub-nozzles 19 disposed in the predetermined locations throughout the width of the loom successively act on the main air flow discharged into the weft guide path by the main nozzle, so that the resulting air flow flows on the side of the wall surfaces 14*a* and 15*a*, although it slightly vibrates between the opening side and the fore wall surface side, that is, it flows in the zigzag direction to a certain degree, while moving through the guide path.

Therefore, it will be understood that the weft guide device of this invention increases the efficiency of air utilization because the amount of air flowing out through the openings 18 and 22 is reduced to as little as possible. This results in greatly decreased power consumption. Furthermore, since the air flow in the weft guide path effectively flows in a stable state, the leading end of the weft also travels in a stable state, resulting in an increased speed of the weft insertion. Furthermore, in this embodiment, the width of the opening 22 thereacross is narrow and remains the same from the lower to the upper end, the weft escape and the flowing out of the air through the opening 22 being able to be positively prevented.

Although in the above-discussed embodiment, the guide members 13*a* each having the interior surface 14 provided with the large opening on the reed side have been mounted in the positions opposite to the sub-nozzle 19, these guide members 13*a* are not always necessary and may be removed. That is, only the sub-nozzle need be provided between the adjacent guide members 13*b*. In this case, the guide device employs only a single kind of guide member, which makes the manufacture thereof easy.

It will be understood from the foregoing that since the upper portion 15*d'* of the rear wall surface 15*d* defining the weft guide opening 16 is curved in the forward direction according to this invention, the effluence of the air through the openings 22 during the weft insertion can be prevented to the utmost. This increases the efficiency of the air utilization in the weft guide device, resulting in the reduced power consumption. Furthermore, as the result of the increase in the efficiency of the air utilization, the most important factors affecting the weft inserting function of the guide device, i.e., the stabilization and the speed-up of the weft movement in the guide path, can be greatly improved. It is of course true that the manufacturing of the guide members is made easy. It is further true that in a jet loom, since the weft was moved through the weft guide path only by the air flow and therefore its movement was relatively unrestrained, it was difficult to provide a wide jet loom. However, according to this invention, a wide jet loom can be realized because of the decreased power consumption and the improved weft inserting function as discussed above.

What we claim is:

1. A weft guide device in a jet loom having a reed carrier for carrying a reed thereon, said device comprising an array of substantially vertically disposed and adjacently aligned weft guide members mounted on said reed carrier along the reed, each of said weft guide members having substantially conjoining and straight upper wall, fore wall, lower wall and rear wall surfaces providing a generally quadrilateral-shaped weft guide opening which, together with said weft guide openings of said other aligned weft guide members, provides a weft guide path, said rear wall surface and said upper wall surface of each of said weft guide members being spaced apart to provide a relatively narrow weft thread opening therebetween to allow a weft thread to move therethrough out of said guide path in preparation for the beating by said reed, and an air discharge member disposed substantially within said guide member array and laterally adjacent to one of said weft guide member rear wall surfaces to discharge air obliquely into said weft guide path and towards said fore wall surfaces, said rear wall surface of each said weft guide member being substantially vertical and having a curved upper portion adjacent to said weft thread opening to direct upwardly moving air currents along said rear wall surface across said weft thread openings and said upper wall surfaces of the weft guide members.

2. A weft guide member for mounting in substantially vertical disposition on a reed carrier in a jet loom, said weft guide member comprising arm portions which together define interiorly facing and substantially conjoining and straight upper wall, fore wall, lower wall and rear wall surfaces providing a generally quadrilateral-shaped weft guide opening, said rear wall surface and said upper wall surface being spaced apart to provide a relatively narrow weft thread opening therebetween, and said rear wall surface being substantially aligned in said vertical direction of the weft guide member and having an upper portion adjacent to said weft thread opening which is curved towards said upper wall surface.

3. A weft guide member according to claim 2, wherein said narrow weft thread opening is substantially straight, and has the same width throughout its length.

* * * * *